United States Patent [19]

Speer et al.

[11] 4,308,976

[45] * Jan. 5, 1982

[54] PERSONAL PROTECTIVE DEVICE

[76] Inventors: Eugene M. Speer, P.O. Box 13745, Orlando, Fla. 32809; Paul G. Hahn, 693 Granville Dr., Winter Park, Fla. 32789

[ * ] Notice: The portion of the term of this patent subsequent to Dec. 30, 1996, has been disclaimed.

[21] Appl. No.: 105,012

[22] Filed: Dec. 19, 1979

Related U.S. Application Data

[60] Division of Ser. No. 944,636, Sep. 21, 1978, Pat. No. 4,241,850, which is a continuation of Ser. No. 633,124, Nov. 18, 1975, abandoned.

[51] Int. Cl.[3] ..... B67B 7/24

[52] U.S. Cl. ..... 222/78; 222/82; 222/175; 224/215

[58] Field of Search ..... 222/5, 80–83, 222/85, 87, 78, 175, 325; 224/215, 219, 267; 239/152, 153

[56] References Cited

U.S. PATENT DOCUMENTS 3,228,565 1/1966 Stanzel ..... 222/82

3,230,912 1/1966 Hohmann ..... 109/20

*Primary Examiner*—H. Grant Skaggs

*Attorney, Agent, or Firm*—Charles W. Helzer

[57] ABSTRACT

A personal protective device for repelling intruders comprising an exterior housing member of attractive appearance designed to be worn by a human being in the normal manner of an article of clothing or a piece of jewelry. The housing member includes a fluid container for storing and dispensing a quantity of fluid. The intruder repellent fluid is completely and safely sealed within the dispenser container until the device is willfully actuated in order to fend off and mark an intruder by an offensive odor and distinguishing color.

9 Claims, 10 Drawing Figures

150
111
128
140
141
149
124
130
112
127

130
127
132
122
123
118
115
126
124
128
125
113
121
114
117
162
129
111
112
131
119
131'

130
126
118
123
113
122
124
125
114
121
129

141
143
144
140
142
128
124
129
149
152
146
151
132
111
148
147
131

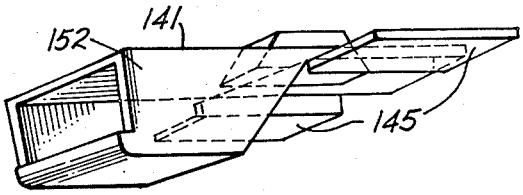
Fig. 5.
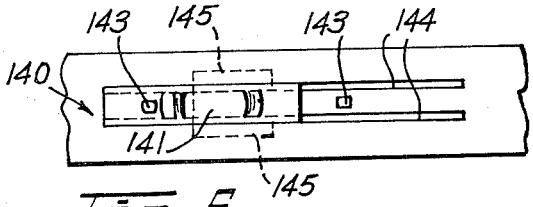
Fig. 6.
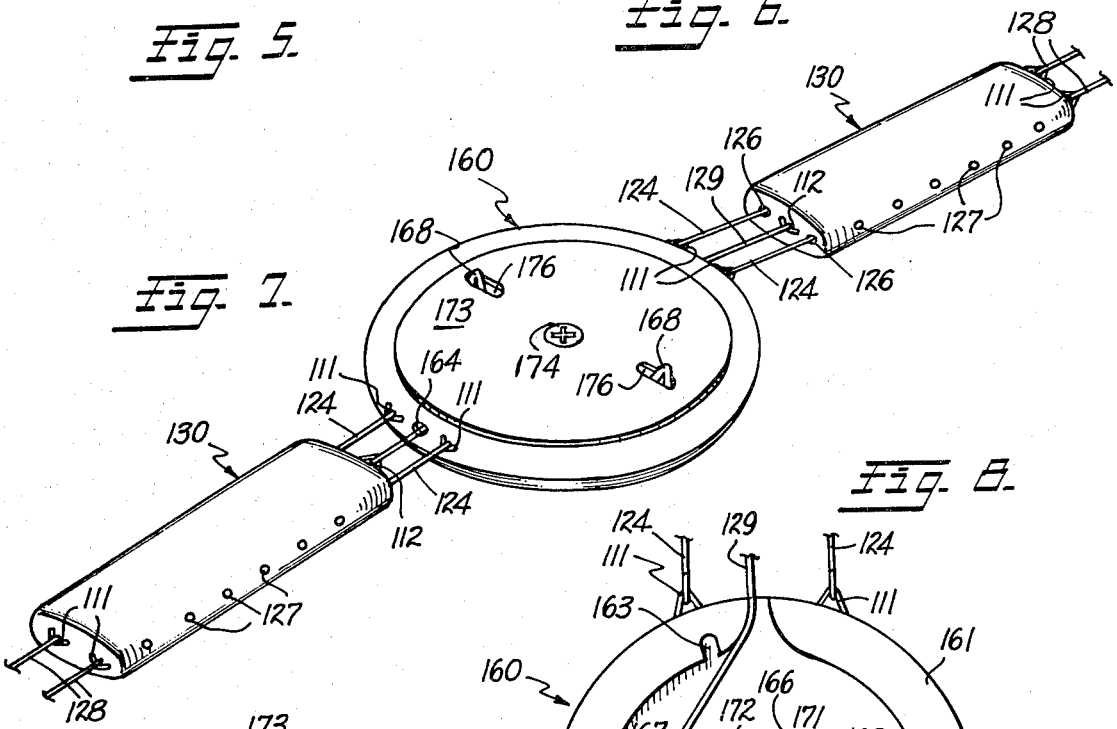
Fig. 7.
Fig. 8.
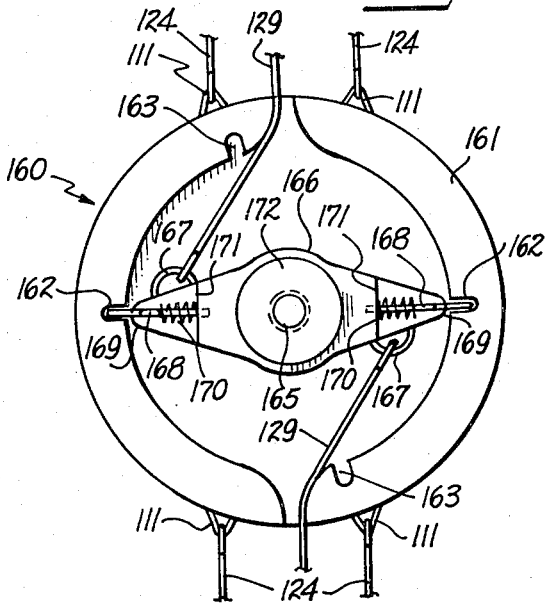
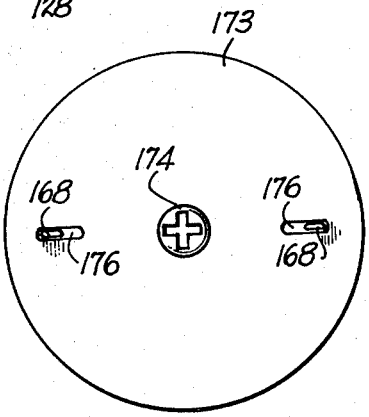
Fig. 10.
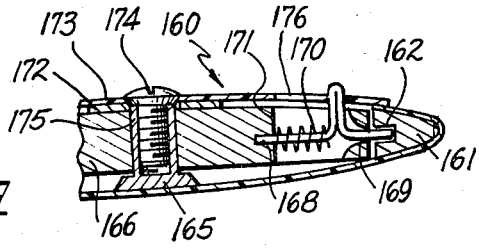
Fig. 9.

PERSONAL PROTECTIVE DEVICE

This is a division of application Ser. No. 944,636, filed Sept. 21, 1978, now U.S. Pat. No. 4,241,850, issued Dec. 30, 1980, which was a continuation of application Ser. No. 633,124 filed Nov. 18, 1975, now abandoned.

BACKGROUND OF INVENTION

1. Field of Invention

This invention relates to a personal protective device for use by an individual in warding off or discouraging attack by an intruder.

More specifically, the invention relates to a protective device in the form of a belt or necklace which can be worn by an individual in the manner of a piece of jewelry or article of clothing, etc., and which upon selective operation by the wearer, ejects a fluid substance of foul and repulsive odor and which also may be colored. The substance serves to mark a prospective attacker both with the repulsive odor and a colored dye mark so that he knows that he can later be identified and thus may be discouraged from pursuing an otherwise intended attack. The fluid substance is harmless and later can be washed off but only with effort and only with suitable washing facilities and cleansers.

2. Prior Art Situation

Historically a number of products have been available to individuals for self defense purposes which range from such items as hand guns, knives, black jacks and the like to the more recently introduced products such as the MACE gas dispenser. Each of these products has certain short comings such as the requirement for special licenses from police authorities, physical strength and adroitness on the part of the user, etc. With respect to the MACE gas dispenser, this item is packaged in the form of an aerosol can which is bulky and unsightly, and normally (if used) is carried within a hand bag, etc. so that it is not readily available if a surprise attack occurs. In order to overcome these deficiencies of the prior art personal protective devices, the present invention was devised.

SUMMARY OF INVENTION

The personal protective device made available by the present invention comprises a light-weight, easily transportable exterior housing member of attractive appearance that simulates a belt or necklace designed to be worn by an individual in a readily accessible manner similar to an article of clothing. The exterior housing member includes a container for a fluid substance of foul and repulsive odor together with a valving arrangement for emitting or forcibly ejecting the odorous fluid in a spray jet against an attacker. These parts are designed as an integral portion of the belt in a manner such that the device is both decorative and inconspicous and disguises the purpose of the device. The fluid container serves as a convenient reservoir for the fluid substance of foul and offensive odor and also includes a safety lock means for preventing inadvertent release of the fluid from the device, but which may be readily armed and thereafter selectively operated by the wearer for use against an attacker. In the event an attack does not occur and the device is not used, it may be returned to the safety locked condition.

In practicing the invention, a personal repellant protective device is provided which comprises an exterior housing member of attractive and inconspicous appearance in the form of a belt. The housing member includes a container for a fluid substance of foul and repulsive odor and at least one outlet opening to the exterior which communicates with the container for the fluid. Selectively actuated valve means coact with the container for releasing the fluid substance through the outlet opening under the control of a person wearing the device. The device is completed by safety lock means on the housing member for positively preventing inadvertent action of the selectively actuable valve means with the safety lock means being selectively operable by a person wearing the device under situations where it is desirable to arm the device and condition it for operation through the medium of the selectively actuable valve means. The container preferably is filled with a fluid substance of a foul and repulsive odor which also is colored so that upon release and contact with an attacker, the attacker will be marked both by a foul odor and a readily identified, visually observable mark. The fluid substance of foul odor preferably is ejected under pressure in the manner of an aerosol spray and may be accompanied by a loud noise intended to startle a prospective attacker. Alternatively, the fluid substance may be emitted in a slow flowing or oozing manner so that the attacker is not aware that he is being marked until it is an accomplished fact.

BRIEF DESCRIPTION OF DRAWINGS

These and other objects, features and many of the attendant advantages of this invention will be appreciated more readily as the same becomes better understood by reference to the following detailed description, when considered in connection with the accompanying drawings, wherein like parts in each of the several figures are identified by the same reference character, and wherein:

FIG. 5 is a perspective view of a slide safety catch employed with the safety locking unit of FIG. 4;

FIG. 6 is a partial side elevational view of the safety catch unit of FIG. 4 showing the relative location of the slide safety switch member, switch spring detents and switch guide slots for the slide safety catch element;

FIG. 7 is a partial, plan perspective view of a second embodiment of the form of the invention shown in FIG. 1 and which employs a different type of safety catch unit that utilizes a rotating release switch element;

FIG. 8 is a sectional plan view of the rotatable safety switch element employed with the embodiment of the invention shown in FIG. 7;

FIG. 9 is a partial side sectional view of the rotatable safety catch element shown in FIG. 8; and FIG. 10 is a plan view of the rotatable safety catch unit cover plate and showing the slots through which access to rotor lock pins is provided whereby a wearer of the belt or necklace readily may set the device to an armed or ready condition.

DETAILED DESCRIPTION OF PREFERRED EMBODIMENTS

Figure 1:
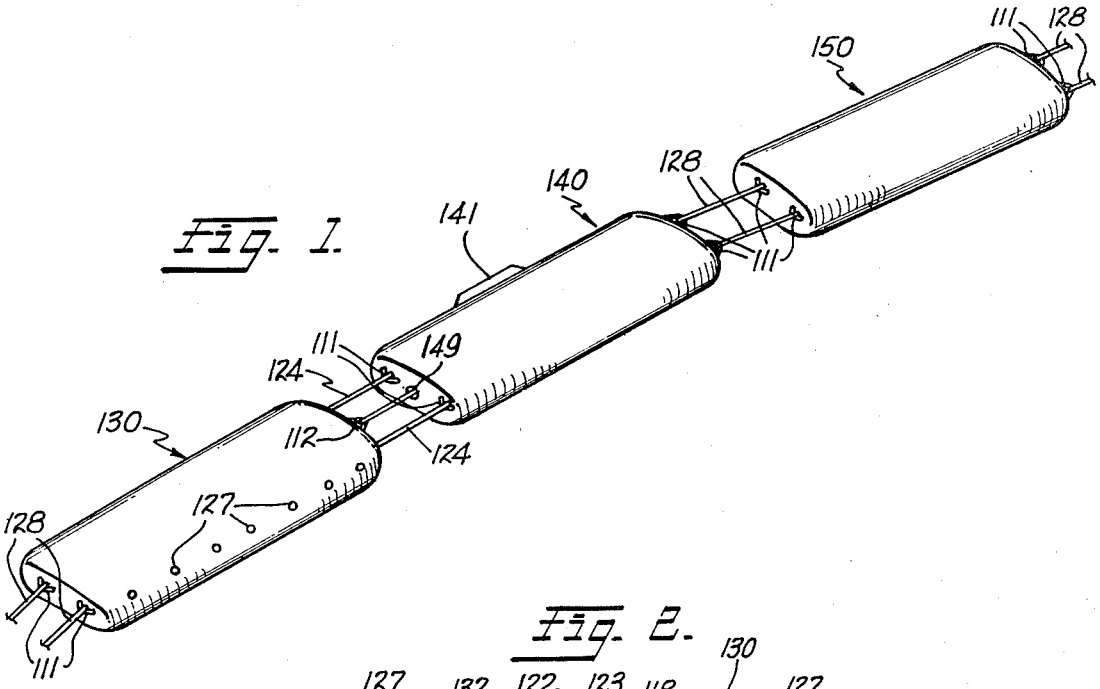
FIG. 1 is a perspective view of an assembled necklace or belt fabricated in accordance with the invention and wherein certain of the link elements of the necklace or belt comprise a container and liquid repellant dispensing component and other link elements comprise a safety lock unit.

The embodiment of the invention shown in FIG. 1 may comprise a jewelry necklace or preferably a belt in which the liquid repellent dispensing device is incorporated as an integral part of the article. For convenience, the article will be treated as a belt and makes available an embodiment of the invention for dispensing liquid repellent onto an intruder who is in physical contact with the wearer of the device. This embodiment of the invention is for use under circumstances where the wearer has been taken completely by surprise. With the embodiment of the invention shown in FIG. 1, it is anticipated that an intruder or attacker will be physically wrestling with the wearer of the device in such a manner that the liquid repellent dispensed from the device not only will be marked on the attacker but of necessity also leaves its mark on the wearer.

The embodiment of the invention shown in FIG. 1 is comprised of a plurality of uniformly appearing links such as 130, 140 and 150 which are of standardized but attractive appearance so as to appear to be standard component parts of a belt design. The links 130, 140 and 150 as well as other links comprising the belt or necklace, are interconnected through chains or cords 128 attached to eyelets 111 formed at the end of each of the links. A suitable buckle such as the one illustrated in FIG. 2 may be provided for the belt. In addition, at one or more locations around the circumference of the belt, certain of the links such as 130 and 140 are specially designed to incorporate respective liquid repellent dispensing means and positive acting safety catch mechanisms.

Figure 2:
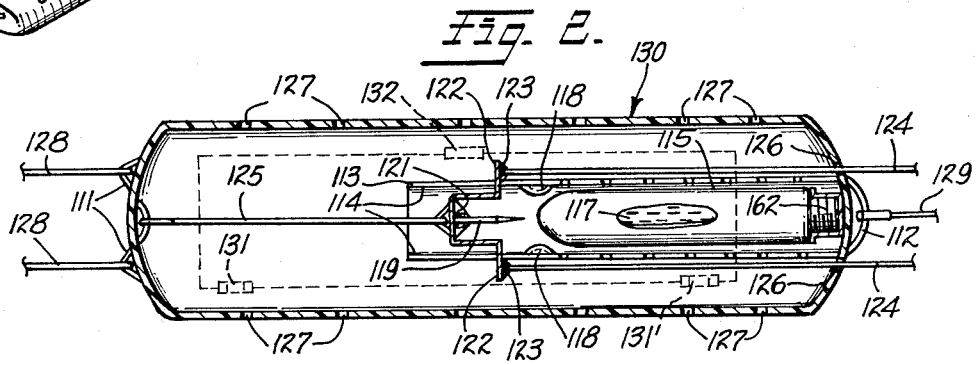
FIG. 2 is a sectional plan view of one of the elements of the belt or necklace shown in FIG. 1 having the fluid repellant dispensing device contained therein.
Figure 3:
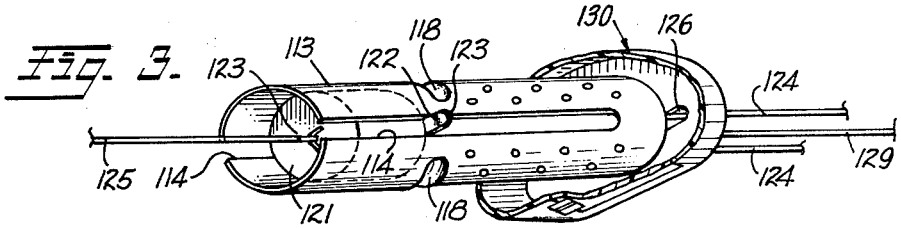
FIG. 3 is a partial perspective view illustrating the construction of a perforated tubular member comprising the fluid repellant dispensing device shown in section in FIG. 2.
Figure 4:
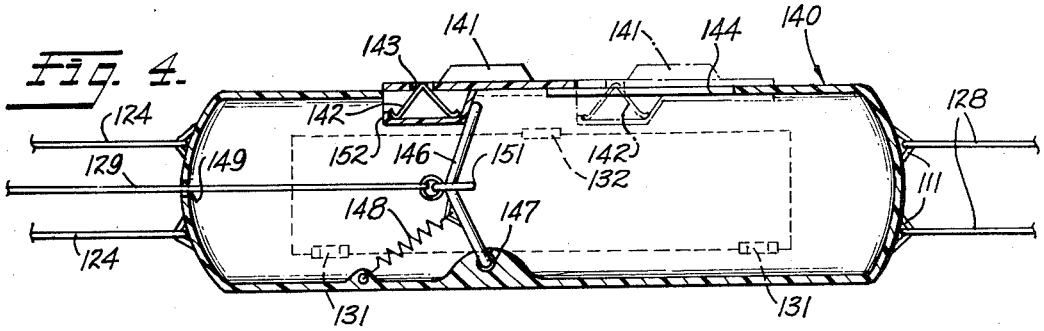
FIG. 4 is a sectional plan view of one of the link elements of the belt or necklace shown in FIG. 1 and illustrates the safety lock component comprising a part of the overall personal protective device of FIG. 1.

FIG. 2 is a sectional plan view of the construction of one of the liquid repellent dispensing links 130 which is interconnected in the belt or necklace through the medium of the cords 128, 124 and 129. The cord or cable 129 is secured to the right hand end of link 130 through the medium of a safety cable eyelet 112. The link 130 is comprised by a relatively flat, semi-elliptically-shaped housing member having a number of perforations 127 formed in its outer surface and a pair of egress openings 126 provided at the same end to which the safety cable eyelet 112 is secured. The openings 126 allow for the passage of a pair of activation cords 124 secured at one end to the link 140, as shown in FIG. 4, and having their remaining end secured to a set of eyelets 123 formed on the opposite ends of a safety pin guide arm 122. The safety pin guide arms 122 are designed to ride within a pair of parallel, oppositely positioned, longitudinal guide slots 114 formed in opposite sides of a perforated guide tube 113 best shown in FIG. 3 and secured within link housing member 130. The perforated guide tube 113 at one end has an internally threaded cup-shaped receptical 162 secured for threadably receiving the externally threaded neck of a repellent liquid container ampule 115 similar in construction to that described with relation to FIGS. 6–10 of U.S. Pat. No. 4,241,850. The safety guide pin arms 122 comprise an integral part of a moveable, cup-shaped puncture pin support 121 which rigidly supports a puncture pin 119. A set of cartridge restraint and sealing indentations of generally flexible construction are shown at 118 and are integrally formed in perforated guide tube 113 intermediate the puncture pin structure 119 and the end of the liquid repellent ampule 115.

The puncture pin support 121 has a safety cable eyelet 123 secured to the side thereof opposite puncture pin 119. One end of a safety cable or cord 125 is secured to the safety cable eyelet 123 and the remaining end of the safety cord 125 is secured to an eyelet 111 formed in the opposite end of the outer housing member 130. To provide access to the interior of the outer housing member 130 and allow an owner of the device to change or insert new ampules as well as safety cords after use of the device, a hinged panel or door is provided as shown in dotted outline form in FIG. 2 and is secured in place by the hinges 131 and snap lock 132 similar in construction to those generally employed in jewelry box design.

It will be appreciated from FIGS. 2 and 3 that upon the device being suitably armed for use (as will be described more fully hereinafter) and the wearer tugging upon the activation cords 124 with sufficient strength to break the safety cord 125, the puncture pin assembly 121 can be caused to slide along the guide slots 114 in perforated tube 113 and to puncture the liquid repellent ampule 115. In doing so, the puncture pin assembly 121 will pass by the restraint and sealing indentations 118 so as to act as a piston and cause the liquid repellent 117 to flow slowly or ooze out through the perforations in perforated tube 113 and the perforations 127 in the outer housing member 130 to thereby contact an intruder or attacker who may be wrestling with the wearer of the device.

FIG. 4 is a sectional plan view of a safety catch unit link 140 which is included in the belt or necklace in a position adjacent to the liquid repellent dispensing link 130. The safety catch link 140 has the standard eyelets 111 formed at each of the ends thereof for connection to the interconnecting cords 128 and the activation cords 124. The safety catch unit link 140 is comprised by an outer metallic or plastic member similar in configuration to the link 130 housing member and has a hinged opening back cover secured to it by hinge members 131 and snap lock closure 132 for providing access to the interior of the link unit. A safety cable egress opening 149 is provided in the left end of safety link unit housing member 140 through which the safety cable 129 passes. Recall that one end of the safety cable 129 is attached to the safety cable eyelet 112 on the liquid repellent dispensing unit link 130 as shown in FIG. 2. The remaining end of safety cable 129 passes through access opening 149 in link unit 140 and is attached to an annular eyelet 151. In the safety lock condition, the central opening in annular eyelet 151 is threaded by a pivoted safety cable lever arm 146 hinged to the safety catch unit housing member 140 at 147. A safety lever arm biasing spring 148 is secured to safety lever arm 146 and to housing member 140 and normally biases lever arm 146 in a direction to cause it to move counter-clockwise from the position shown in FIG. 4.

The free end of the safety cable lever arm 146 normally is restrained in the safety condition by a safety switch 141 whose construction is better shown in FIGS. 5 and 6 of the drawings. Safety switch 141 normally is maintained in its leftmost position shown in FIG. 4 by the action of lever arm 146 against the tapered front face of a depending detent portion 152 of safety switch 141. To further restrain the safety switch 141 in its leftmost position shown in solid outline form in FIG. 4, a detent spring 142 is mounted within the detent portion 152 of the switch assembly and coacts with a detent opening 143 in the link unit outer housing as shown in FIGS. 4 and 6. The safety catch unit is changed from its safety lock condition shown in solid line FIG. 4 to the armed or ready condition by merely sliding the safety switch 141 from its solid line position to the right to its dotted line position shown in FIG. 4. To accommodate this movement, switch guide slots 144 are formed in the upper surface of the unit housing member 140 along with the detent openings 143.

In operation, the liquid repellent dispensing device shown in FIGS. 1–6 normally will be maintained in its safety lock condition as shown in solid line in the drawings. Upon sensing danger, or otherwise entering a dangerous area where attack might occur, the wearer of the device will slide the safety lock switch 141 to its ready dotted line position shown in FIG. 4. In doing so, the tapered front face of the detent portion 152 of safety switch 141 will slide over the end of safety lever arm 146 because of the resilience provided to the lever arm by safety spring 148. Upon the safety switch 141 reaching its dotted outline position, it will be retained there by the detent spring 142 and lever arm 146 will be allowed to pivot counter-clockwise from the position shown in FIG. 4 thereby allowing the safety eyelet 151 to slip over its free end and release the safety cable or cord 129. In this manner, the liquid repellent dispensing device will be conditioned in the armed or ready configuration.

After being conditioned to the armed or ready configuration as described in the preceeding paragraph, the wearer may then selectively actuate the liquid repellent dispensing device by tugging or pulling on the activation cords 124. The device is designed in such a manner that the basic interconnecting link chains or cords 128 are of sufficient size to sustain a tension force of approximately 20 lbs. each. The activation cords 124 are sized to sustain a tension force of approximately 10 lbs. each while the safety cable 129 is sized to be capable of sustaining a tension force of approximately 25 lbs. However, the restraint cord 125 in the liquid repellent dispensing unit 130 is designed to sustain a tension force of approximately only 10 lbs. Thus, the restraint cord 125 is the weakest link in the belt or necklace. With the belt or necklace in the ready or armed condition as described above, the application of a pulling or tugging on the activation cords 124 or for that matter any location of the belt or necklace which results in a tension force of greater than approximately 10 lbs., will cause failure of the restraint cord 25. With the restraint cord 25 broken by such pulling or tugging action, continued application of the pulling or tugging on the belt will cause the activation cords 124 to pull the pin guide arms 122, pin guide support member 121 and puncture pin 119 towards the liquid repellent cartridge 117. This will result in rupturing of the cartridge and will free the liquid repellent so that it flows or oozes through the perforations in the perforated guide tube 113 as well as the perforations 127 in the outer linking unit housing member 130. If the pulling or tugging is continued, or if the pulling or tugging is violent in nature, the activation cords 124 will continue pulling the pin guide assembly 121 towards the collapsing cartridge 117 to thereby increase the rate of flow or oozing of the liquid repellent from the interior of the container housing member 130 through the liquid egress holes 127. As the propellent liquid egresses from the holes 127 it will be deposited upon the wearers' person or clothing and if he or she is in physical contact with an attacker, likewise will be deposited upon the attacker.

In the event of a surprise attack under conditions where the wearer is not first able to arm the device by releasing the safety lock lever arm 146 in the above described manner, the device nevertheless can be operated by the application of a suitable pulling or tugging force which results in a tension force on the safety cable equal to or exceeding approximately 25 lbs. With a pulling or tugging force of this magnitude, the heavy wire safety lever arm 146 is designed to bend sufficiently in the direction of the predesigned bend shown in FIG. 4, to become dislodged from under the depending detent portion 152 of safety catch switch assembly 141. This should result in freeing the eyelet 151 from the end of lever arm 146, but in any event is sufficient to produce enough slack to allow the activation cords 124 to be operated in the above described manner to release the liquid repellent in ampule 115.

A second species of the embodiment of the invention described in the preceeding paragraphs with relation to FIGS. 1–6, is illustrated in FIG. 7. The species of the invention shown in FIG. 7 likewise is designed to comprise either a belt or a necklace and employs one or more liquid repellent link units 130 identical to those described with relation to FIGS. 1–6. The species of the invention shown in FIG. 7 differs however in the construction of the safety catch unit 60 employed with the necklace or belt. In this species of the invention, the safety catch unit 60 may comprise a belt buckle or catch for the necklace.

The construction of the safety catch link unit 60 is best shown in FIGS. 7–10 and comprises a simultaneous release for the safety cables 129 employed to lock the repellent liquid dispensing unit 131 in the safety condition. FIG. 8 is a sectional plan view of the safety catch unit link 160 which comprises a relatively flat circular housing member having the eyelets 111 formed on opposite sides of its periphery for attachment to activation codes 124 of the liquid repellent dispensing unit links 130. Formed on the outer face of the round link housing member 160 is a rotor pin restraint ring 161 of generally annular configuration having two sets of lock pin recesses 162 and 163, respectively, formed in its inner periphery and located substantially 90° apart. As illustrated in FIG. 8, the rotor pin restraint ring 161 provides a first set of lock pin recesses 162 for maintaining the unit in the safe condition or configuration and the second set of lock pin recesses 163 to maintain the unit in the ready or armed condition. Safety cable egress openings 164 are provided through the rotor pin restraint ring 161 to allow egress of the safety cables 129 with one end of each safety cable 129 being secured to an eyelet 167 formed on a rotor member 166 that is supported for rotation within the restraint ring 161 by a rotor support axle 165. The rotor member 166 is slideably mounted in place on the rotor support axle 165 and is held there by a rotor cover plate spacer 172 mounted on the rotor support axle 165 beneath a rotor cover plate 173 best seen in FIG. 10 of the drawings. The cover plate 173 is held in place by an attachment screw 174 threaded into a mating threaded hole formed in the rotor support axle 165. FIG. 9 of the drawings shows a partial cross sectional view through one side of the rotor assembly with the cover plate 173 held in place in the above described manner.

The rotor member 166 is a generally elongated elliptically-shaped structure having a partition wall 171 secured in each of the opposite ends thereof to define a lock pin support chamber. A retractible rotor lock pin 168 is secured in each chamber and is biased outwardly by a suitable biasing spring disposed between the partition plates 171 and an upstanding, readily grasped hairpin turn formed in lock pin 168. The hairpin turn in lock pin 168 protrudes upwardly through aperture opening 176 in the rotor cover plate 173 as best shown in FIGS. 9 and 10. The rotor lock pin 168 has one end thereof extending through an opening in the partition plate 171 and secured there by a cotter pin, or other suitable means, and has the remaining free end thereof extending through a suitable hole formed in the end of the rotor member 166 and into respective ones of the lock pin recesses 162 or 163 formed in the rotor pin restraining ring 161. The rotor lock pin spring 170 acts in compression to keep the rotor lock pin 168 pressed into either the pair of lock pin recesses 162 for the safety lock position, or into lock pin recesses 163 for the ready-armed condition.

The device of FIGS. 7–10 is placed in the ready or armed condition by squeezing the two rotor lock pin-hairpin shaped protuberances 168 extending through cover plate 173 together towards the rotor support axle 165 to thereby free the rotor lock pins and enable the rotor member 166 to be rotated. With the rotor lock pins positioned in the lock pin recesses 162 as shown in FIG. 8 of the drawings, the safety cables 129 will be stressed, and the device will be set to the safety lock condition. However, upon rotation of the rotor member 166 in the above described manner to allow the lock pins 168 to be seated in the recesses 163, the safety cords 129 will be slacked so as to enable the wearer to operate the device through grasping or pulling on the actuation cables 124 in the manner previously described with respect to FIGS. 1–6. Thus, it will be appreciated that the device of FIGS. 7–10 operates in essentially the same manner as the device illustrated in FIGS. 1–6. There is one considerable advantage to the device of FIGS. 7–10, however, and that is that it is more easily returned to the safety lock condition after it has been enabled or placed in the ready-armed condition for use by the wearer.

From the foregoing description it will be appreciated that the invention makes available a light-weight, portable, easily fabricated and relatively inexpensive repellent fluid dispensing device that is incorporated into a piece of jewelry such as a necklace, belt or other suitable exterior wearing apparel or article so as to be inconspicuous. The device provides a means for forcibly ejecting or slowly flowing a liquid repellent that is applied to a potential attacker or intruder and that marks the intruder with both a foul and repulsive odor and a distinctive color marking which is visually apparent and readily viewed. Because of the nature of the fluid contained within the device, the device includes a means for positively preventing inadvertent release of the liquid or fluid from the device which means readily can be operated by a wearer to place the device in a ready-armed condition for use in situations of danger.

Having described several embodiments of a personal protective repellant dispensing device constructed in accordance with the invention, it is believed obvious that other modifications and variations of the invention are possible in the light of the above teachings. It is therefore to be understood that changes may be made in the particular embodiments of the invention described which are within the full intended scope of the invention as defined by the appended claims.

What is claimed is:

1. A personal protective repellent dispensing device comprising a belt having an exterior housing member of of attractive appearance which is conveniently worn by a person in a readily accessible manner and which disguises the nature of the device, container means for containing a fluid substance of foul and repulsive nature secured within the exterior housing member, said exterior housing member having outlet openings to the exterior thereof communicating with said containing means, selectively controllable puncture pin means movable with respect to said container means for puncturing the container and releasing a fluid substance contained therein through the outlet openings under the control of a person wearing the device, actuation cord means fixed to the remainder of the belt for selectively moving the puncture pin means relative to the container upon a person wearing the device pulling on the belt with a given amount of force required to relatively move the puncture pin means and the container to thereby puncture the container and release the fluid, and positive acting safety catch means for positively preventing inadvertent relative movement between the puncture pin means and the container.

2. A personal protective repellant dispensing device according to claim 1 wherein said safety catch means comprises breakable safety cord means for preventing relative movement between said puncture pin means and the container until a person wearing the belt pulls on it with a force in excess of said given amount to thereby break the breakable safety cord means and produce relative movement between the puncture pin means and the container.

3. A personal protective repellent dispensing device according to claim 2 wherein said safety catch means further includes additional safety cord means secured between the container and the remainder of the belt for further preventing relative movement between the puncture pin means and the container in a safety locked condition, said additional safety cord means being of greater strength than said breakable safety cord means, and means for changing said additional safety cord means from the safety locked condition to a relaxed ready armed condition so that it does not interfere with relative movement between the puncture pin means and the container.

4. A personal protective repellent dispensing device according to claim 3 wherein said safety catch means further includes a pivoted locking lever for tensioning said additional safety cord means to counteract the effect of said actuation cord means, and a sliding latch member coacting with said pivoted locking lever in the safety lock position to retain the additional safety cord means taut, said sliding latch member being selectively moveable to a second release position for slackening the additional safety cord means to thereby arm the device for operation by the first set of actuation cords.

5. A personal protective repellent dispensing device according to claim 3 wherein said safety catch means further includes a rotatable locking member for tensioning said additional safety cord means to counteract the effect of said actuation cord means upon rotation to a first safety locking rotational position and upon rotation to a second rotational position serves to relax the additional safety cord means to thereby arm the device for operation by the actuation cord means.

6. A personal protective repellent dispensing device according to claim 2 wherein the device can be returned to the safety locked condition in the event the device is not operated while in the ready armed condition.

7. A personal protective repellent dispensing device according to claim 3 wherein the fluid oozes out of the container after puncturing.

8. A personal protective repellent dispensing device according to claim 3 wherein the fluid of foul and repulsive nature is retained in an ampule container, and puncturing of the container releases the contents of the ampule through the outlet openings in the manner of an aerosol spray.

9. A personal protective repellent dispensing device according to either of claims 1, 2 or 3 wherein the fluid substance of foul and repulsive nature also is colored so that upon release and contact with an intruder, the intruder will be marked both by a foul odor and a readily identified visually observable mark.

* * * * *